US008556126B2

(12) United States Patent
Lee

(10) Patent No.: US 8,556,126 B2
(45) Date of Patent: Oct. 15, 2013

(54) SMALL HAND-OPERATED SPRAYER

(75) Inventor: Chung Kee Lee, Seoul (KR)

(73) Assignee: Chong Woo Co., Ltd., Inchon (KR)

( * ) Notice: Subject to any disclaimer, the term of this patent is extended or adjusted under 35 U.S.C. 154(b) by 282 days.

(21) Appl. No.: 13/001,241

(22) PCT Filed: Jul. 20, 2009

(86) PCT No.: PCT/KR2009/004000
§ 371 (c)(1),
(2), (4) Date: Mar. 16, 2011

(87) PCT Pub. No.: WO2010/013908
PCT Pub. Date: Feb. 4, 2010

(65) Prior Publication Data

US 2011/0155764 A1 Jun. 30, 2011

(30) Foreign Application Priority Data

Jul. 30, 2008 (KR) ..... 20-2008-0010167 U

(51) Int. Cl.
*B05B 11/00* (2006.01)

(52) U.S. Cl.
USPC ..... 222/153.13; 222/321.8; 222/384

(58) Field of Classification Search
USPC ..... 222/153.11, 153.13, 321.7, 321.8, 222/383.1, 384, 402.11
See application file for complete search history.

(56) References Cited

U.S. PATENT DOCUMENTS 4,082,223 A * 4/1978 Nozawa ..... 239/333
4,159,067 A * 6/1979 Akers ..... 222/153.02
4,245,759 A * 1/1981 Baker et al. ..... 222/146.5
4,427,134 A * 1/1984 Almouli ..... 222/153.11
4,449,647 A * 5/1984 Reed et al. ..... 222/153.09
4,506,805 A * 3/1985 Marcon ..... 222/153.13
4,880,143 A * 11/1989 Murray et al. ..... 222/135
5,839,616 A * 11/1998 Irwin et al. ..... 222/321.8

(Continued)

FOREIGN PATENT DOCUMENTS

JP 08-196955 8/1996
JP 09-192552 7/1997
KR 10-2000-0063513 11/2000

OTHER PUBLICATIONS

International Search Report and Written Opinion for PCT/KR2009/004000 mailed on Feb. 5, 2010 and its English translation.

(Continued)

*Primary Examiner* — Kevin P Shaver
*Assistant Examiner* — Donnell Long
(74) *Attorney, Agent, or Firm* — Ladas & Parry, LLP

(57) ABSTRACT

A small hand-operated sprayer for spraying small volumes of content includes a main body coupled to a top of a container and a hand-operated pump mounted inside the main body to pump content out of the container through movement of a button mounted on top of the hand-operated pump. The button includes a vertical channel communicating with the hand-operated pump and a horizontal channel extending from the vertical channel, a spray nozzle mounted in the horizontal channel in the button, a trigger having one side at which a portion of the button including the spray nozzle is exposed and an opposite side rotatably coupled to the main body such that the trigger presses the button downward when a handle of the trigger is pulled and returns to an original position due to restoring force when the handle is released, and a locking device enabling or disabling operation of the trigger.

8 Claims, 5 Drawing Sheets

(56) References Cited

U.S. PATENT DOCUMENTS

| | | | | |
|---|---|---|---|---|
| 6,286,723 | B1 * | 9/2001 | Sweeton et al. | 222/153.13 |
| 8,225,964 | B2 * | 7/2012 | Clark | 222/153.14 |
| 2007/0158368 | A1 * | 7/2007 | Tada | 222/321.8 |

OTHER PUBLICATIONS

International Preliminary Report on Patentability for PCT/KR2009/004000 issued on Mar. 1, 2011 and its English translation.

* cited by examiner

10

30

SMALL HAND-OPERATED SPRAYER

CROSS-REFERENCE TO RELATED APPLICATIONS

This application is the U.S. National Stage of International Patent Application No. PCT/KR2009/004000 filed on Jul. 20, 2009, which claims priority to Korean Patent Application Number 20-2008-0010167 filed on Jul. 30, 2008, the disclosures of which are hereby incorporated by reference in its entirety.

TECHNICAL FIELD

The present invention relates to a small hand-operated sprayer for spraying small volumes of content, and more particularly to a small hand-operated sprayer including a main body forming an exterior of the sprayer, the main body being coupled to a top of a container that holds content, a hand-operated pump mounted inside the main body to pump content out of the container through up-and-down movement of a button, the button having a hollow structure mounted on top of the hand-operated pump such that the button communicates with the hand-operated pump, the button including a vertical channel communicating with the hand-operated pump and a horizontal channel extending from the vertical channel, a spray nozzle mounted in the horizontal channel in the button, a trigger having one side at which a front end portion of the button including the spray nozzle is exposed and an opposite side that is rotatably coupled to the main body, and a locking device provided at a rotational coupling portion of the trigger and the main body.

BACKGROUND ART

A hand-operated sprayer serves to dispense a specific volume of liquid content stored in a container per pumping operation. Such hand-operated sprayers are often applied to containers that store liquid content such as bath products or insect repellants.

Particularly, small hand-operated sprayers are widely used for cosmetic or perfume containers since the hand-operated sprayer allows liquid content stored in the container to be easily sprayed out in units of small volumes, and relevant technologies have been steadily developed.

A conventional small hand-operated sprayer mainly includes a main body forming an exterior of the sprayer, a pump for pumping content through up-and-down movement of a button inside the main body, the button including a spray nozzle formed therein and being mounted on the top of the pump, and a trigger having one side at which a front end portion of the button is exposed, the trigger being coupled to the main body such that a handle of the trigger can be pulled.

However, this conventional small hand-operated sprayer can be problematic in that content is dispensed as soon as the trigger is depressed. That is, when the trigger is unintentionally depressed since the user drops the sprayer or since unintentional external force is applied to the trigger, the sprayer is immediately activated to discharge content.

To prevent such an unintentional activation of the sprayer, a cap may be attached to the nozzle of the sprayer. However, this requires an additional troublesome process of removing and replacing the cap when the sprayer is used. In addition, the cap is easily lost.

To overcome these problems, the cap may be integrally mounted on the nozzle. However, when the sprayer is activated after the cap is detached, the cap may obstruct spraying since the cap is located near the nozzle.

Although small hand-operated sprayers having various structures have been developed to overcome such problems, there is currently no practical small hand-operated sprayer that provides satisfactory results.

DISCLOSURE

Technical Problem

Therefore, the present invention has been made in view of the above problems, and it is an object of the present invention to provide a small hand-operated sprayer in which a locking device is provided at a position, which does not obstruct spraying, to prevent a trigger from being unintentionally depressed due to dropping of the sprayer or unintentional external force applied to the trigger.

Technical Solution

In accordance with an aspect of the present invention, the above and other objects can be accomplished by the provision of a small hand-operated sprayer for spraying small volumes of content, the sprayer including (a) a main body forming an exterior of the sprayer, the main body being coupled to a top of a container that holds content, (b) a hand-operated pump mounted inside the main body to pump content out of the container through up-and-down movement of a button, (c) the button having a hollow structure mounted on top of the hand-operated pump such that the button communicates with the hand-operated pump, the button including a vertical channel communicating with the hand-operated pump and a horizontal channel extending from the vertical channel, (d) a spray nozzle mounted in the horizontal channel in the button, (e) a trigger having one side at which a front end portion of the button including the spray nozzle is exposed and an opposite side that is rotatably coupled to the main body such that the trigger presses the button downward when a handle of the trigger is pulled and the trigger returns to an original position due to restoring force when the handle is released, and (f) a locking device provided at a rotational coupling portion of the trigger and the main body, the locking device enabling or disabling operation of the trigger with respect to the main body as needed.

In the small hand-operated sprayer of the present invention having the above structure, when the user does not wish to use the sprayer, they may press downward the locking device located at the rotational coupling portion of the trigger and the main body to disable operation of the trigger and, when the user wishes to use the sprayer, they may move upward the locking device to enable operation of the trigger to dispense content stored in the container to a desired location.

When the sprayer is activated, the nozzle can spray content pumped from the container to a desired location without being restricted by the locking device since the locking device is located at the rotational coupling portion of the trigger and the main body.

In a preferred embodiment, an inner rib extending downward is formed on the trigger at a front portion of the rotational coupling portion, a protruding portion extending upward is formed inside the main body at a position corresponding to the inner rib, the inner rib and the protruding portion are spaced apart from each other so as to form a gap therebetween, the gap allowing rotation of the trigger with respect to the main body when the handle of the trigger is pulled, and a front end portion of the locking device is inserted into the gap between the inner rib and the protruding portion when the trigger is in a locked state.

The small hand-operated sprayer operates on the principle that, when the handle of the trigger is pulled, the trigger is rotated downward by a certain angle to depress the button to dispense content. When the locking device is depressed to restrict such activation, the front end portion of the locking device is inserted into the gap between the inner rib, which is formed on the inner side of the trigger, and the protruding portion extending upward, which is formed in the main body at a position corresponding to the inner rib.

Accordingly, operation of the trigger can be easily enabled or disabled as the locking device is inserted into or removed from the gap between the inner rib of the trigger and the protruding portion of the main body.

In this case, the locking device may include a locking portion that is inserted into or removed from the gap to disable or enable operation of the trigger and an operating portion extending from the locking portion while being exposed from the sprayer, the operating portion being operated to cause the locking portion to be inserted into or removed from the gap.

According to this structure of the locking device, the locking device can prevent unintentional depression of the trigger due to dropping of the sprayer or unintentional external force since the locking portion is inserted into the gap between the inner rib of the trigger and the protruding portion of the main body. The locking portion can also be easily inserted into and removed from the gap using the operating portion that extends from the locking portion and that is exposed from the sprayer.

The operating portion may include a support that is hingedly connected to the locking portion.

Accordingly, when the operating portion is moved upward, the support hingedly connected to the locking portion is bent such that the locking portion can be easily removed from the gap between the inner rib of the trigger and the protruding portion.

In another example, the locking device may be structured such that the support comes into contact with the inner rib to fix the trigger when the locking portion is moved downward and the support is moved upward when the locking portion is moved downward.

As described above, the locking portion and the support are connected to each other at a joint. For example, a groove may be formed at a lower portion of the joint between the locking portion and the support such that the locking portion and the support can more easily bend at the joint.

Preferably, the support has a shape corresponding to an upper portion of the main body such that the support is in close contact with an upper inner surface of the main body when the operating portion is operated (or moved) upward. For example, the support may be formed in an arched or curved shape.

The shape of the locking portion is not particularly limited, provided that the locking portion can easily control rotation of the trigger while remaining in contact with the inner rib of the trigger. For example, the locking portion may be formed in the shape of a horizontal plate (i.e., in the shape of a plate when viewed from above).

The shape of the operating portion of the locking device is not particularly limited, provided that the user can easily depress the operating portion. For example, a part of the operating portion which is exposed from the main body may be formed in a horizontal semicircular shape (i.e., a semicircular shape when viewed from above) such that the user can easily depress the operating portion by their finger.

The spray nozzle may include a plurality of ribs formed on an outer surface of the spray nozzle and content in the container may be dispensed through a flow path formed between the ribs of the spray nozzle and an inner surface of the button. For example, the ribs may be formed radially or symmetrically. This allows content stored in the container to be widely dispersed upon passing through the ribs of the spray nozzle.

DESCRIPTION OF DRAWINGS

The above and other objects, features and other advantages of the present invention will be more clearly understood from the following detailed description taken in conjunction with the accompanying drawings, in which.

MODE FOR INVENTION

Embodiments of the present invention will be described with reference to the drawings. However, it should be noted that the description of the embodiments is given only for better understanding of the present invention and the scope of the present invention is not limited by the embodiments.

Figure 1:
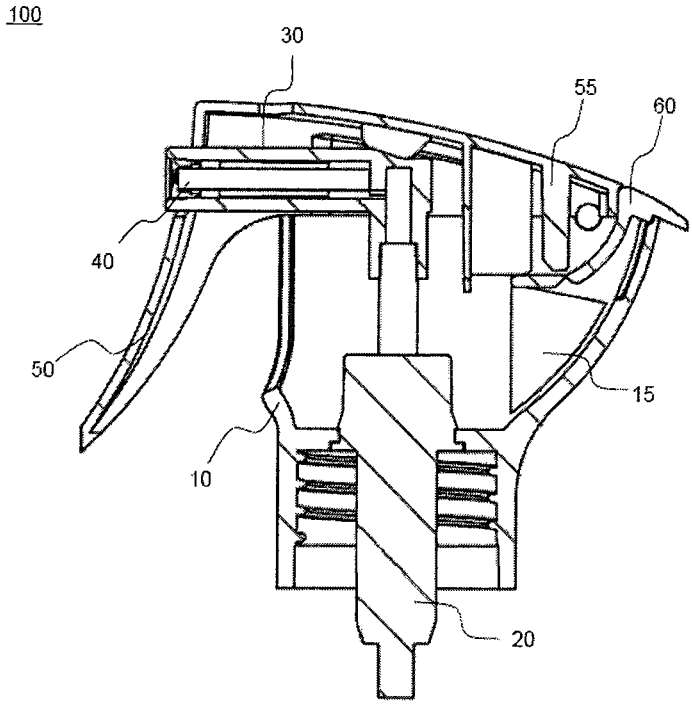
FIG. 1 is a schematic cross-sectional view of a small hand-operated sprayer according to an embodiment of the present invention.

FIG. 1 is a schematic cross-sectional view of a small hand-operated sprayer according to an embodiment of the present invention.

As shown in FIG. 1, the small hand-operated sprayer 100 includes a main body 10, a hand-operated pump 20, a button 30, a spray nozzle 40, a trigger 50, and a locking device 60. The main body 10 forms the exterior of the small hand-operated sprayer 100 and is coupled to the top of a container (not shown) that holds content. The hand-operated pump 20 is mounted inside the main body 10 and pumps content out of the container through up-and-down movement of the button 30. The button 30 has a hollow structure and is mounted on the top of the hand-operated pump 20 such that the button 30 communicates with the hand-operated pump 20. The spray nozzle 40 is mounted in a horizontal channel formed within the button 30. A front end portion of the button 30 including the spray nozzle 40 is exposed at one side of the trigger 50 while the opposite side of the trigger 50 is rotatably coupled to the main body 10. The locking device 60 is located at a rotational coupling portion where the trigger 50 and the main body 10 are rotatably coupled to each other.

FIG. 1 illustrates the locking device 60 of the small hand-operated sprayer 100 in a locked state in which the locking device 60 is inserted between an inner rib 55 of the trigger 50 and a protruding portion 15 in the main body 10 while remaining in contact with the inner rib 55, thereby preventing downward rotation of the trigger 50.

Figure 2:
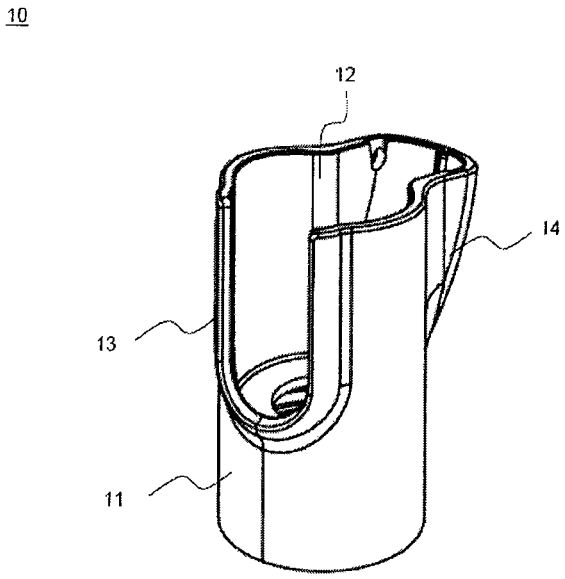
FIG. 2 is a perspective view of a main body of FIG. 1.
Figure 3:
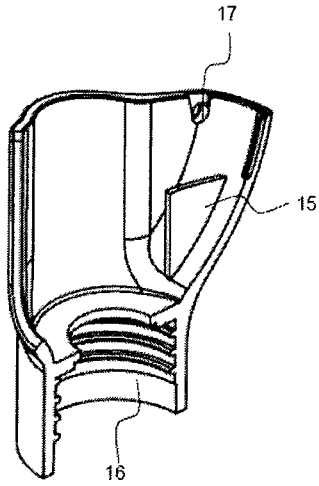
FIG. 3 is a schematic vertical cross-sectional view of the main body of FIG. 2.

FIG. 2 is a schematic perspective view of the main body of FIG. 1 and FIG. 3 is a schematic vertical cross-sectional view of the main body of FIG. 2.

Referring to FIGS. 2 and 3 in combination with FIG. 1, the main body 10 has a substantially cylindrical body 11 having an open top 12.

The main body 10 has a front portion 13 that is cut out in a U shape so that the inside of the main body 10 is exposed through the front portion 13. This secures a space required for downward rotation of a handle of the trigger 50.

A rear portion 14 of the main body 10 has an outwardly protruding shape, which gradually increases in size from a middle portion of the outer surface of the cylindrical body 11 to the top, such that an arch-shaped support of the locking device 60 can be in close contact with an inner surface of the rear portion 14 of the main body. The protruding portion 15 is formed on the inner surface of the rear portion 14 so that the protruding portion 15 contacts a locking portion that is a component of the locking device 60.

The main body 10 has a coupling groove 16 at the bottom thereof. The coupling groove 16 is tightly threaded to provide a good seal for coupling to the container that holds content. The main body 10 also has a recessed groove 17 at an upper portion thereof.

Figure 4:
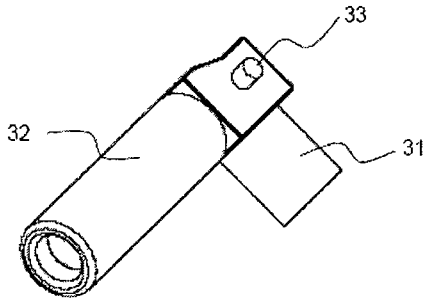
FIG. 4 is a perspective view of a button of FIG. 1.
Figure 5:
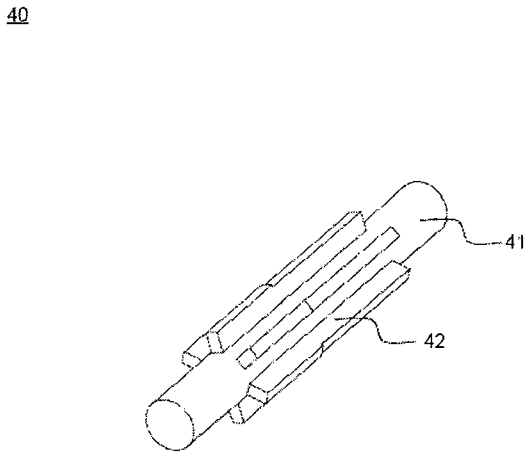
FIG. 5 is a perspective view of a spray nozzle of FIG. 1.

FIG. 4 is a schematic perspective view of the button of FIG. 1 and FIG. 5 is a schematic perspective view of the spray nozzle of FIG. 1.

Referring to FIGS. 4 and 5 in combination with FIG. 1, the button 30 includes a vertical channel 31, a horizontal channel 32, and a protrusion 33. Each of the vertical channel 31 and the horizontal channel 32 has a hollow cylindrical structure. The horizontal channel 32 extends from the vertical channel 31 and the outwardly protruding projection 33 is formed on a curved joint between the vertical channel 31 and the horizontal channel 32.

The spray nozzle 40 includes a cylindrical shaft 41 and ribs 42 which are radially formed on the outer surface of the cylindrical shaft 41. The spray nozzle 40 is mounted inside the horizontal channel 32 of the button 30 such that radial flow paths are formed between the ribs 42 and the inner surface of the horizontal channel 32. When the handle of the trigger 50 is pulled, content first passes through the vertical channel 31 and is then widely dispersed upon passing through the radial paths formed between the horizontal channel 32 and the ribs 42 of the spray nozzle.

Figure 6:
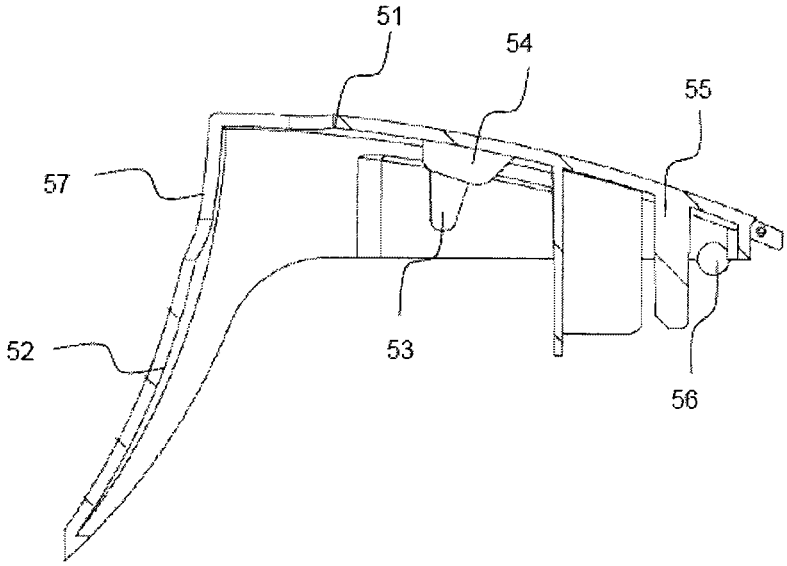
FIG. 6 is a schematic cross-sectional view of a trigger of FIG. 1.

FIG. 6 is a schematic cross-sectional view of the trigger of FIG. 1.

Referring to FIG. 6 in combination with FIGS. 1 and 3, the trigger 50 includes a cover 51 located at the top of the main body 10 and a handle 52 for activating the sprayer.

The cover 51 is arch-shaped and covers the open top of the main body 10. The cover 51 includes a button depression portion 53 for depressing the button 30, a trigger guide 54, an inner rib 55, and a coupling portion 56 for rotatably coupling the cover 51 to the main body 10.

The button depression portion 53 is formed on the inner surface of the cover 51 at a position corresponding to the button 30. The button depression portion 53 protrudes to a certain height for depressing the button 30 such that the button depression portion 53 can press the button 30 downward when the trigger 50 is rotated downward. The inner rib 55 extends downward from the rear inner surface of the cover 51. The protruding portion 15 that extends upward is formed inside the main body 10 at a position corresponding to the inner rib 55 of the trigger 50.

The inner rib 55 and the protruding portion 15 are spaced apart from each other so as to form a gap therebetween which allows rotation of the trigger 50 with respect to the main body 10 when the handle 52 of the trigger 50 is pulled. The front end portion of the locking device 60 is inserted into the gap between the inner rib 55 and the protruding portion 15 when the trigger 50 is in a locked state.

The coupling portion 56 is located at the rear side of the inner rib 55 of the trigger 50 and is formed in the shape of a circular protrusion. The coupling portion 56 is inserted in the recessed groove 17 to couple the main body 10 to the trigger 50.

The handle 52 of the trigger 50 extends downward from the left side of the cover 51 to a certain length such that the handle 52 can be easily grasped by a finger. Outlets 57 of the radial flow paths are exposed at an upper portion of the handle 52.

Figure 7:
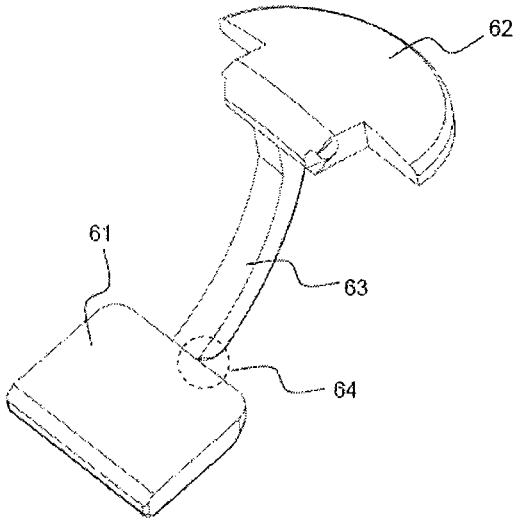
FIG. 7 is a perspective view of a locking device of FIG. 1.

FIG. 7 is a schematic perspective view of the locking device of FIG. 1.

Referring to FIG. 7 in combination with FIGS. 1 and 6, the locking device 60 includes a locking portion 61 for enabling or disabling the operation of the trigger 50 and an operating portion 62 that is exposed outside of the sprayer 100 to operate the locking device 60 upward or downward.

The locking portion 61 is formed in the shape of a horizontal plate (i.e., in the shape of a plate when viewed from above) such that the locking portion 61 is easily inserted into or removed from the gap between the inner rib 55 of the trigger 50 and the protruding portion 15 of the main body 10. When the locking portion 61 is moved downward, the locking portion 61 comes into contact with the inner rib 55 of the trigger 50 to fix the trigger 50.

A part of the operating portion 62 is exposed outside of the small hand-operated sprayer 100. The exposed part of the operating portion 62 is in a horizontal semicircular shape (i.e., a semicircular shape when viewed from above) and the bottom of the operating portion 62 is connected to the support 63.

The bottom of the support 63 is hingedly connected to the locking portion 61. A groove 64 is formed at a lower portion of a joint between the locking portion 61 and the support 63 to facilitate bending at the joint.

The support 63 has a shape corresponding to an upper portion of the main body 10 and comes into close contact with the inner upper surface of the main body 10 when the operating portion 62 is operated upward.

Figure 8:
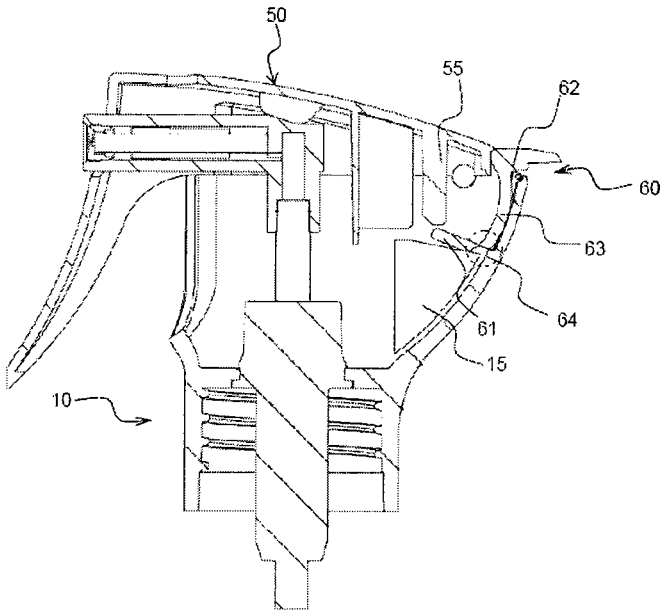
FIG. 8 is a cross-sectional view of a small hand-operated sprayer when the locking device of FIG. 1 is in an unlocked state.
Figure 9:
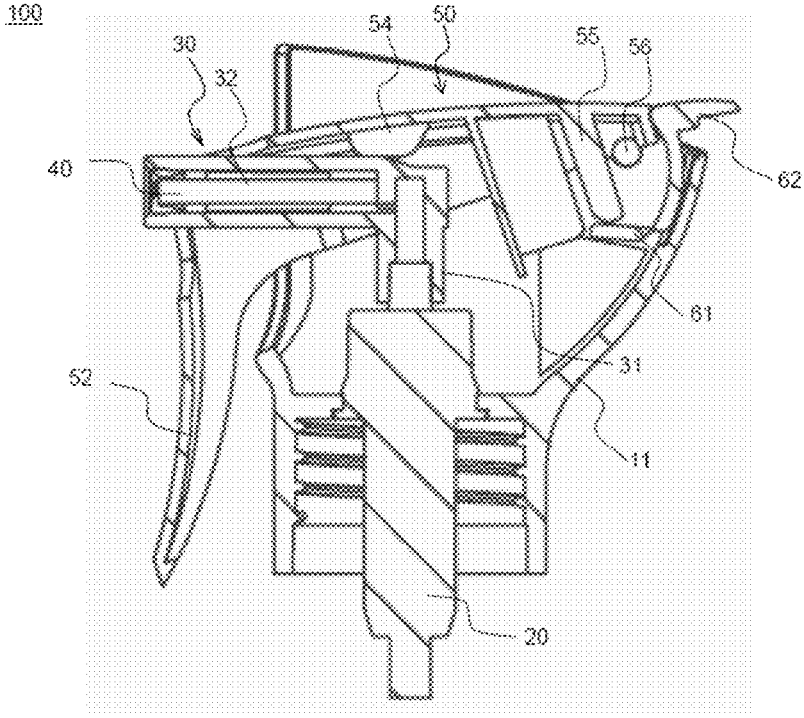
FIG. 9 is a cross-sectional view of the small hand-operated sprayer when the trigger is pulled in the state of FIG. 8.

FIG. 8 is a schematic cross-sectional view of a small hand-operated sprayer when the locking device of FIG. 1 is in an unlocked state and FIG. 9 is a schematic cross-sectional view of the small hand-operated sprayer when the trigger is pulled in the state of FIG. 8.

As shown in FIG. 8, when the operating portion 62 of the locking device 60 is moved upward, operation of the trigger is enabled. As the operating portion 62 is moved upward, the locking portion 61 and the support 63 are also moved upward while the locking portion 61 is removed from between the inner rib 55 of the trigger 50 and the protruding portion 15 of the main body 10. The joint between the support 63 and the locking portion 61 has a hinge structure 64 such that the locking device 60 easily bends at the joint when the locking device 60 is moved upward. The support 63 is moved upward while remaining in close contact with the inner surface of the main body 10, thereby opening the gap between the inner rib 55 of the trigger 50 and the protruding portion 15 of the main body 10.

Accordingly, as shown in FIG. 9, the trigger 50 is rotated downward until the locking portion 61 of the locking device 60 comes into contact with the inner rib 55 of the trigger 50. Here, the handle 52 of the trigger 50 is rotated about an axis corresponding to both the recessed groove (not shown) of the main body 10 and the coupling portion 56 of the trigger 50.

While the trigger 50 is rotated downward, the trigger guide 54 of the trigger 50 presses the button 30 downward. This allows the hand-operated pump 20 to pump content in the container (not shown). The pumped content passes through the vertical channel 31 and the horizontal channel 32 of the button 30 and is then ejected from the sprayer.

Figure 10:
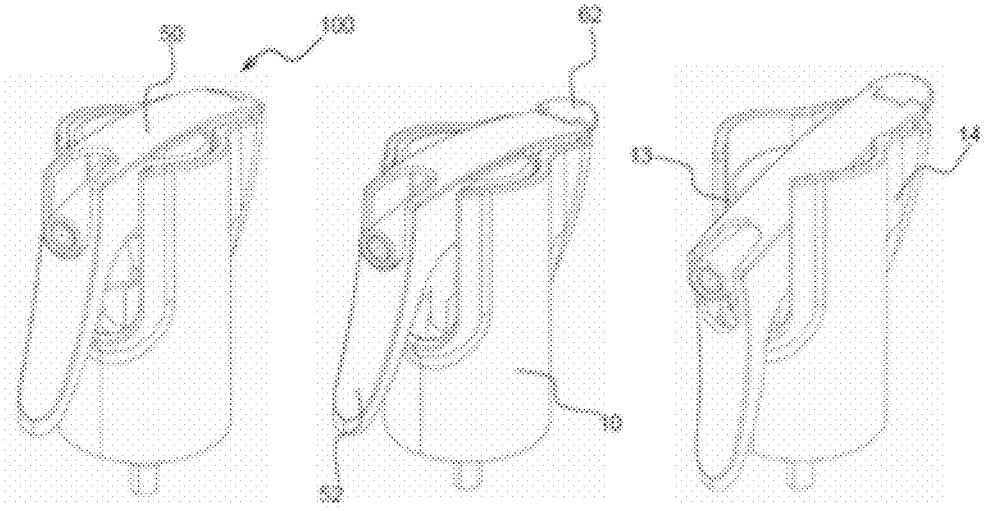
FIG. 10 are perspective views illustrating the sequence of operation of the small hand-operated sprayer of FIG. 1.

FIG. 10 are schematic perspective views illustrating the sequence of operation of the small hand-operated sprayer of FIG. 1.

As shown in FIG. 10, first, the operating portion 62 of the locking device 60 which is in a locked state is moved upward. Then, the handle 52 of the trigger 50 is pulled so that the handle 52 is rotated downward through the front portion 13 of the main body 10 which is opened in a U shape. This allows the trigger 50 to depress the button (not shown), causing the pump to pump content stored in the container (not shown). As a result, content is sprayed uniformly to a desired location outside the sprayer.

INDUSTRIAL APPLICABILITY

The small hand-operated sprayer according to the present invention prevents the trigger from being unintentionally depressed due to dropping of the sprayer or unintentional external force applied to the trigger, thereby preventing loss of content, since the locking device is provided at a position which does not obstruct spraying.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A small hand-operated sprayer for spraying small volumes of content, the sprayer comprising:

(a) a main body forming an exterior of the sprayer, the main body being coupled to a top of a container that holds content;

(b) a hand-operated pump mounted inside the main body to pump content out of the container through up-and-down movement of a button;

(c) the button having a hollow structure mounted on top of the hand-operated pump such that the button communicates with the hand-operated pump, the button including a vertical channel communicating with the hand-operated pump and a horizontal channel extending from the vertical channel;

(d) a spray nozzle mounted in the horizontal channel in the button;

(e) a trigger having one side at which a front end portion of the button including the spray nozzle is exposed and an opposite side that is rotatably coupled to the main body such that the trigger presses the button downward when a handle of the trigger is pulled and the trigger returns to an original position when the handle is released; and (f) a locking device provided at a rotational coupling portion of the trigger and the main body, the locking device enabling or disabling operation of the trigger with respect to the main body as needed;

wherein an inner rib extending downward is formed on the trigger at a front portion of the rotational coupling portion, a protruding portion extending upward is formed inside the main body at a position corresponding to the inner rib, the inner rib and the protruding portion are spaced apart from each other so as to form a gap therebetween, the gap allowing rotation of the trigger with respect to the main body when the handle of the trigger is pulled, and a front end portion of the locking device is inserted into the gap between the inner rib and the protruding portion when the trigger is in a locked state.

2. The small hand-operated sprayer according to claim 1, wherein the locking device includes:

a locking portion that is inserted into or removed from the gap to disable or enable operation of the trigger; and an operating portion extending from the locking portion while being exposed from the sprayer, the operating portion being operated to cause the locking portion to be inserted into or removed from the gap.

3. The small hand-operated sprayer according to claim 2, wherein the operating portion includes a support that is hingedly connected to the locking portion.

4. The small hand-operated sprayer according to claim 3, wherein a groove is formed at a lower portion of a joint between the locking portion and the support to facilitate bending at the joint.

5. The small hand-operated sprayer according to claim 3, wherein the support has a shape corresponding to an upper portion of the main body such that the support is in contact with an upper inner surface of the main body when the operating portion is operated upward.

6. The small hand-operated sprayer according to claim 2, wherein the locking portion has a horizontal plate shape.

7. The small hand-operated sprayer according to claim 2, wherein a part of the operating portion is exposed from the main body, the exposed part having a horizontal semicircular shape.

8. The small hand-operated sprayer according to claim 1, wherein the spray nozzle includes a plurality of ribs formed on an outer surface of the spray nozzle and content in the container is dispensed through a flow path formed between the ribs of the spray nozzle and an inner surface of the button.

* * * * *